US008668302B2

(12) United States Patent
Ramesh et al.

(10) Patent No.: US 8,668,302 B2
(45) Date of Patent: Mar. 11, 2014

(54) SYSTEM AND METHOD FOR PRINTING FULL-COLOR COMPOSITE IMAGES IN AN INKJET PRINTER

(75) Inventors: Palghat S. Ramesh, Pittsford, NY (US); Bruce E. Thayer, Spencerport, NY (US); Rachael L. McGrath, Churchville, NY (US)

(73) Assignee: Xerox Corporation, Norwalk, CT (US)

( * ) Notice: Subject to any disclaimer, the term of this patent is extended or adjusted under 35 U.S.C. 154(b) by 57 days.

(21) Appl. No.: 13/495,452

(22) Filed: Jun. 13, 2012

(65) Prior Publication Data

US 2013/0335473 A1 Dec. 19, 2013

(51) Int. Cl.
*B41J 29/393* (2006.01)

(52) U.S. Cl.
USPC ..... 347/19

(58) Field of Classification Search
USPC ..... 347/16, 19, 105
See application file for complete search history.

(56) References Cited

U.S. PATENT DOCUMENTS

| | | | | |
|---|---|---|---|---|
| 6,370,354 | B1 | 4/2002 | Chapman et al. | |
| 6,505,023 | B2 | 1/2003 | Miyamoto | |
| 7,177,585 | B2 | 2/2007 | Matsuzaka et al. | |
| 7,390,084 | B2 | 6/2008 | Folkins | |
| 7,407,245 | B2 * | 8/2008 | Endo | 347/14 |
| 7,430,380 | B2 | 9/2008 | Hamby et al. | |
| 7,530,656 | B2 * | 5/2009 | Endo et al. | 347/16 |
| 7,672,634 | B2 | 3/2010 | Lofthus et al. | |
| 7,706,731 | B2 | 4/2010 | Martin et al. | |
| 7,734,225 | B2 | 6/2010 | Mashtare et al. | |
| 7,756,454 | B2 | 7/2010 | Crean et al. | |
| 7,869,739 | B2 | 1/2011 | Mashtare et al. | |
| 7,920,279 | B2 | 4/2011 | Ernst et al. | |
| 7,959,151 | B2 * | 6/2011 | Fukube | 271/258.01 |
| 8,005,415 | B2 | 8/2011 | Ng et al. | |
| 8,068,259 | B2 | 11/2011 | Tojima et al. | |
| 8,096,650 | B2 | 1/2012 | McConville | |
| 8,121,505 | B2 | 2/2012 | Jackson | |
| 2010/0236438 | A1 | 9/2010 | Roof et al. | |
| 2011/0064506 | A1 | 3/2011 | Spence et al. | |

* cited by examiner

*Primary Examiner* — Lamson Nguyen
(74) *Attorney, Agent, or Firm* — Maginot, Moore & Beck, LLP

(57) ABSTRACT

An inkjet printer includes a plurality of color separation modules. Each color separation module includes an image receiving member and a printhead module configured to eject ink drops onto the image receiving member to form a color separation on the image receiving member. The printer is configured to transfix each color separation on each image receiving member to a single sheet to produce a composite ink image on the print medium after the print medium has passed by all of the color separation modules in the printer.

13 Claims, 6 Drawing Sheets

SYSTEM AND METHOD FOR PRINTING FULL-COLOR COMPOSITE IMAGES IN AN INKJET PRINTER

TECHNICAL FIELD

The system and method disclosed in this document relate to inkjet printers generally, and, more particularly, to systems and methods for printing full-color composite images in an inkjet printer.

BACKGROUND

Inkjet printers have printheads configured with a plurality of inkjets that eject liquid ink onto an image receiving surface. The ink can be aqueous, oil, solvent-based, UV curable ink, or an ink emulsion. Other inkjet printers receive ink in a solid form and then melt the solid ink to generate liquid ink for ejection onto the image receiving surface. In these solid ink printers, the solid ink can be in the form of pellets, ink sticks, granules or other shapes. The solid ink pellets or ink sticks are typically placed in an ink loader and delivered through a feed chute or channel to a melting device that melts the ink. The melted ink is then collected in a reservoir and supplied to one or more printheads through a conduit or the like. In other inkjet printers, ink can be supplied in a gel form. Gel inks are also heated to a predetermined temperature to alter the viscosity of the ink so the ink is suitable for ejection by a printhead.

A typical full width scan inkjet printer uses one or more printheads. Each printhead typically contains an array of individual nozzles for ejecting drops of ink across an open gap to an image receiving surface to form an image. The image receiving surface can be the surface of a continuous web of recording media, the surfaces of a series of media sheets, or the surface of an image receiving member, such as a rotating print drum or endless belt. When the image receiving surface is the surface of an image receiving member, the printing process is generally referred to as offset printing. Images printed on the rotating surface are later transferred and fixed to recording media by a mechanical force sometimes aided by thermal energy in a transfix nip formed by the rotating surface and a transfix roller.

In an inkjet printhead, individual piezoelectric, thermal, or acoustic actuators respond to an electrical voltage signal, sometimes called a firing signal, to generate mechanical forces that eject ink through a nozzle from an ink filled pressure chamber. The amplitude, frequency, and/or duration of the firing signals affect the amount of ink ejected in each drop. A printhead controller generates the firing signals with reference to electronic image data to eject individual ink drops at particular locations on the image receiving surface to form an ink image. The locations where the ink drops landed are sometimes called "ink drop locations," "ink drop positions," or "pixels." Thus, a printing operation can be viewed as the placement of ink drops on an image receiving surface with reference to image data.

In some offset printing operations, a single image can cover the entire surface of the image receiving member (single pitch) or a plurality of images can be deposited on the image receiving member (multi-pitch). Furthermore, the images can be deposited in a single pass (single pass method), or the images can be deposited in a plurality of passes (multi-pass method). When the images are deposited on the image receiving member according to the multi-pass method, a portion of the image is deposited by the printheads during a first rotation of the image receiving member. Then during one or more subsequent rotations of the image receiving member, the printheads deposit the remaining portions of the image above or adjacent to the first portion printed. For example, one type of a multi-pass printing architecture is used to accumulate images from multiple color separations. On each rotation of the image receiving member, ink drops for one of the color separations are ejected from the printheads and deposited on the surface of the image receiving member until the last color separation is deposited to complete the image. In some printing operations, for example, printing operations using secondary or tertiary colors, one ink drop or pixel can be placed on top of another one, as in a stack.

Existing offset printers face challenges when printing full-color composite images at high speed. The process speed of the printer, which is often measured in pages per minute (ppm), is limited by, among other parameters, the rotational speed and the size of the image receiving member and the number of rotations required to accumulate the color-separated images. To increase the process speed of such an offset printer, the size of the image receiving member can be increased to enable the printheads to form the color-separated images on the image receiving member in fewer rotations. However, the surface of the image receiving member must be large enough to accommodate the print zones needed for high-resolution full-color imaging, such as 600 dots per inch (dpi). Moreover, the increased size of the image receiving member can lead to challenges in heating and cooling of the image receiving member during printing operations and in transferring the composite image from the image receiving member with acceptable image quality and wrinkle resistance. Accordingly, improvements to offset inkjet printers that form full-color high-resolution composite images with higher throughput would be beneficial.

SUMMARY

A printer implements a method for printing images in an inkjet printer. The printer includes a frame, a plurality of color separation modules mounted within the frame, each color separation module of the plurality of color separation modules including an image receiving member and a printhead module configured to eject ink drops onto the image receiving member to form an ink image on the image receiving member, a media transport system configured to move a print medium past the plurality of color separation modules, a plurality of fixing members, each fixing member being positioned adjacent to one of the image receiving members to form a plurality of nips into which the media transport system delivers the print medium, the nips being configured to transfix the ink image from each of the image receiving members onto the print medium, a first sensor configured to generate a signal indicative of a position of the print medium prior to the print medium entering the plurality of nips, and a controller operatively connected to each of the color separation modules, the media transport system, and the first sensor, the controller being configured to detect the position of the print medium with reference to the signal generated by the first sensor, and operate the plurality of color separation modules to synchronize entry of the ink image on each image receiving member with entry of the print medium into each nip with reference to the detected position of the print medium to generate a full-color ink image on the print medium.

A method has been developed for printing images in an inkjet printer. The method includes operating each color separation module in a plurality of color separation modules to form an ink image on an image receiving member in each color separation module, forming a nip with each image receiving module as a print medium approaches the image receiving member of each imaging module, and transfixing the ink image on each image receiving member on the print medium in each nip to produce a composite ink image on the print medium after the print medium has passed by all of the imaging modules in the plurality of color separation modules.

BRIEF DESCRIPTION OF THE DRAWINGS

The foregoing aspects and other features of the system and method for printing full-color composite images in an inkjet printer are explained in the following description, taken in connection with the accompanying drawings.

DETAILED DESCRIPTION

Figure 1:
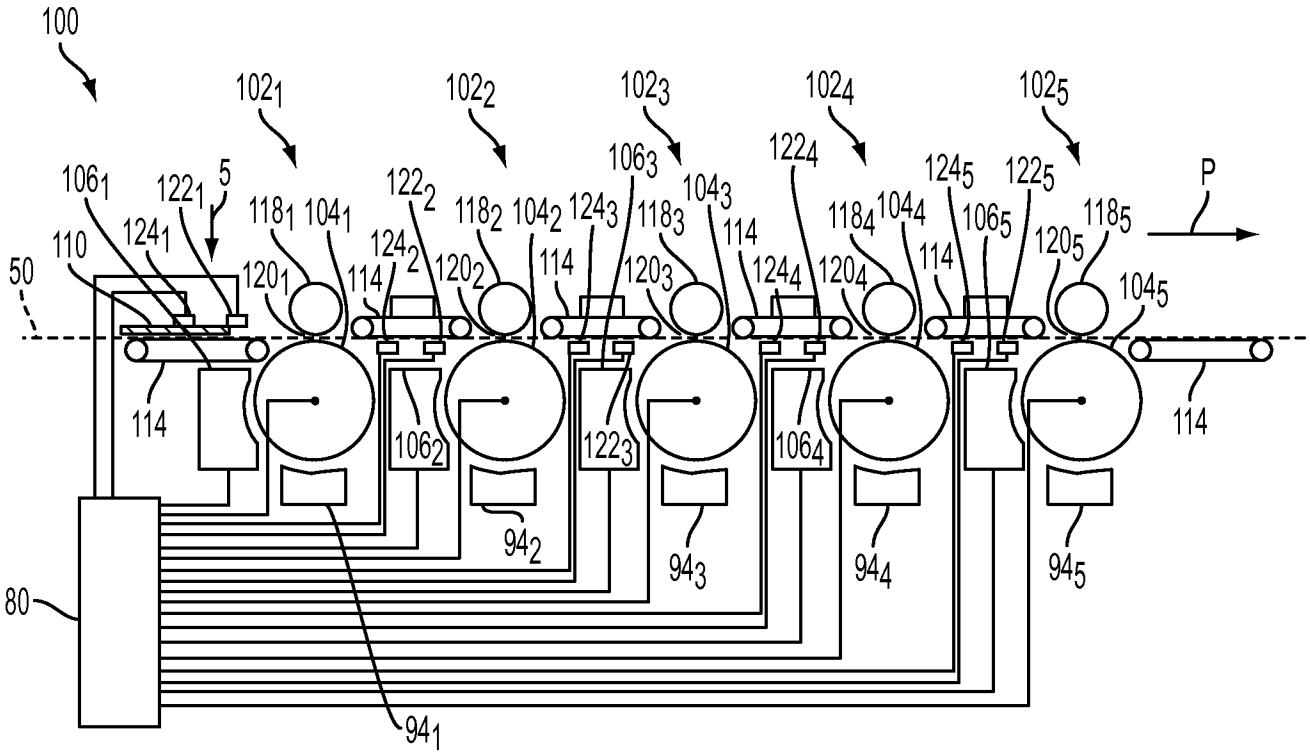
FIG. 1 is a schematic representation of a marking station of an inkjet printer that is modified to implement a process for printing full-color composite images.

For a general understanding of the environment for the inkjet printer disclosed herein as well as the details of the method for printing full-color composite images in the inkjet printer, the drawings are referenced throughout this document. In the drawings, like reference numerals designate like elements.

Figure 7:
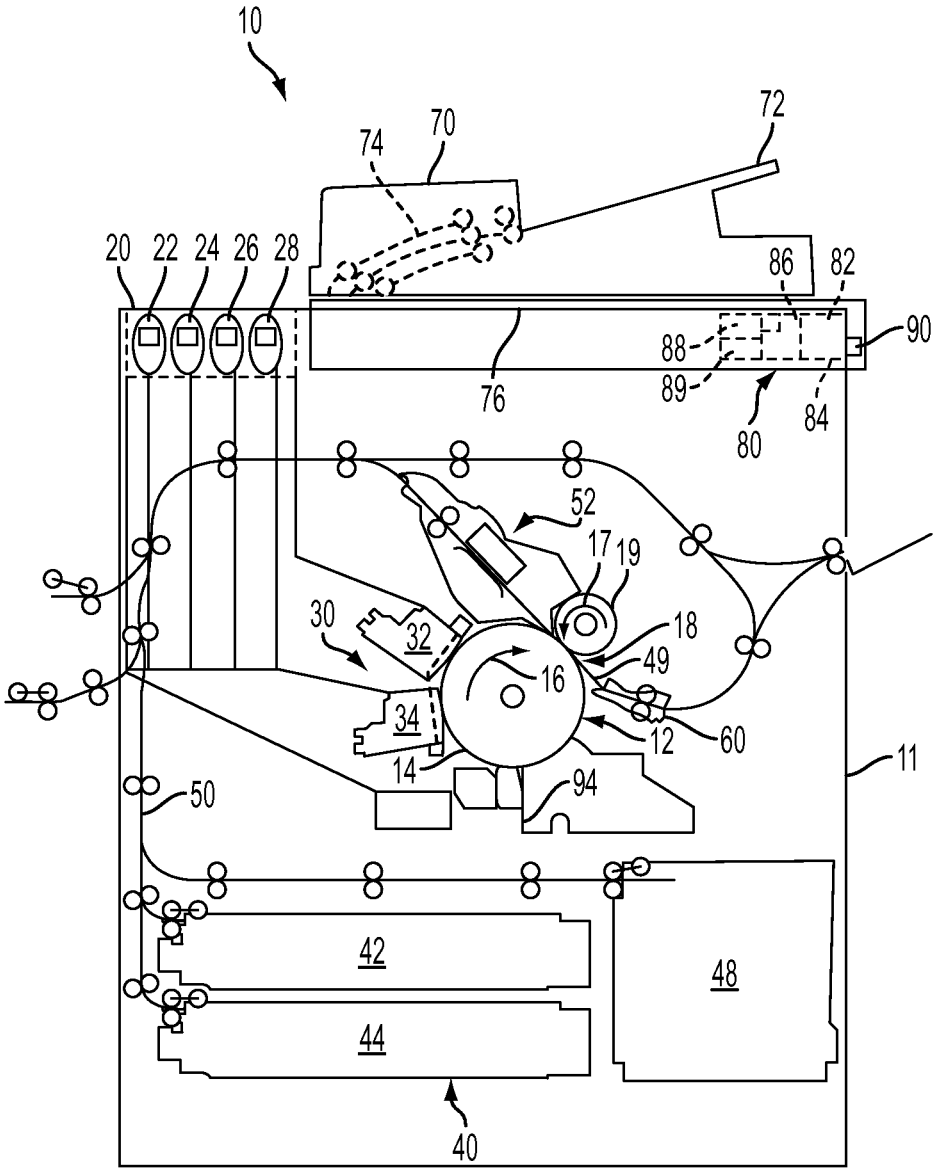
FIG. 7 PRIOR ART
FIG. 7 is a block diagram of a prior art phase change ink printer.

Referring now to FIG. 7, a phase change ink printer 10 is depicted. As illustrated, the printer 10 includes a frame 11 to which are mounted directly or indirectly all operating subsystems and components of the printer 10. The printer 10 further includes an image receiving member 12 that is shown in the form of a drum, but can equally be in the form of a supported endless belt. The image receiving member 12 has an imaging surface 14 that is movable in the direction 16, and on which phase change ink images are formed. As used herein, "process direction" refers to the direction in which the image receiving member 12 moves as the imaging surface 14 passes the printhead to receive the ejected ink and "cross-process direction" refers to the direction across the width of the image receiving member 12. An actuator (not shown) is operatively connected to the image receiving member 12 and configured to rotate the image receiving member 12 in the direction 16.

The printer 10 further includes a phase change ink system 20 that has at least one source 22 of one color phase change ink in solid form. As illustrated, the printer 10 is a multicolor printer, and the ink system 20 includes four sources 22, 24, 26, 28, representing four different colors of phase change inks, e.g., CYMK (cyan, yellow, magenta, black). The phase change ink system 20 also includes a phase change ink melting and control assembly (not shown) for melting or phase changing the solid form of the phase change ink into a liquid form. Phase change ink is typically solid at room temperature. The ink melting assembly is configured to heat the phase change ink to a melting temperature selected to phase change or melt the solid ink to its liquid or melted form. As is generally known, phase change inks are typically heated to a melting temperature of approximately 70° C. to 140° C. to melt the solid ink for delivery to the printhead(s).

After the solid ink is melted, the phase change ink melting and control assembly controls and supplies the molten liquid form of the ink towards a printhead system 30 including at least one printhead assembly 32 and, in the figure, a second printhead assembly 34. Assemblies 32 and 34 include printheads that enable color or monochrome printing. In one embodiment, each assembly holds two printheads, each of which ejects four colors of ink. The printheads in each assembly are stitched together end-to-end to form a full-width four color array. In another embodiment, each printhead assembly 32 and 34 includes four separate printheads, i.e., one printhead for each color. In yet another embodiment, the printheads of assembly 34 are offset from the printheads of assembly 32 by one-half of the distance between nozzles in the cross-process direction. This arrangement enables the two printhead assemblies, each printing at the first resolution, for example, 300 dpi, to print images at a higher second resolution, in this example, 600 dpi. This higher second resolution can be achieved with multiple full-width printheads or numerous staggered arrays of printheads. In this embodiment, the staggered array in one printhead assembly ejecting one color of ink at the first resolution is offset from the staggered array in the other printhead assembly ejecting the same color of ink by the amount noted previously to enable the printing in the color at the higher second resolution. Thus, the two assemblies, each having four staggered arrays or four full-width printheads, can be configured to print four colors of ink at the second higher resolution. While two printhead assemblies are shown in the figure, any suitable number of printheads or printhead assemblies can be employed.

Referring still to FIG. 7, the printer 10 further includes a substrate supply and handling system 40. The substrate supply and handling system 40 includes substrate supply sources 42, 44, and 48, of which supply source 48, for example, is a high capacity paper supply or feeder configured to store and supply image receiving substrates in the form of cut sheets. The substrate supply and handling system 40 further includes a substrate handling and treatment system 50 that has a substrate pre-heater 52 and can also include a fusing/spreading device 60. The printer 10 as shown can also include an original document feeder 70 that has a document holding tray 72, document sheet feeding and retrieval devices 74, and a document exposure and scanning system 76.

Sheets (substrates) comprising any medium on which images are to be printed, such as paper, transparencies, boards, labels, and the like are drawn from the substrate supply sources 42, 44, 48 by feed mechanisms (not shown). The substrate handling and treatment system 50 moves the sheets in a process direction (P) through the printer for transfer and fixing of the ink image to the media. The substrate handling and treatment system 50 can comprise any form of device that is adapted to move a sheet or substrate. For example, the substrate handling and treatment system 50 can include nip rollers or a belt adapted to frictionally move the sheet and can include air pressure or suction devices to produce sheet movement. The substrate handling and treatment system 50 can further include pairs of opposing wheels (one or both of which can be powered) that pinch the sheets.

Operation and control of the various subsystems, components, and functions of the printer 10 are performed with the aid of a controller 80. The controller 80, for example, is a self-contained, dedicated mini-computer having a central processor unit (CPU) 82 with electronic storage 84, and a display or user interface (UI) 86. The controller 80 includes a sensor input and control circuit 88 as well as a pixel placement and control circuit 89. In addition, the CPU 82 reads, captures, prepares, and manages the image data flow from the image input sources, such as the scanning system 76 or an online or a work station connection 90. The controller 80 generates the firing signals for operating the printheads in the printhead assemblies 32 and 34 with reference to the image data. As such, the controller 80 is the main multi-tasking processor for operating and controlling all of the other printer subsystems and functions.

The controller 80 further includes memory storage for data and programmed instructions. The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the functions of the printer 10. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

In operation, image data for an image to be produced is sent to the controller 80 from either the scanning system 76 or via the online or work station connection 90 for processing and output to the printhead assembly 32. Additionally, the controller 80 determines and/or accepts related subsystem and component controls, for example, from operator inputs via the user interface 86, and accordingly executes such controls. As a result, appropriate color solid forms of phase change ink are melted and delivered to the printhead assemblies 32 and 34. Pixel placement control is exercised relative to the imaging surface 14 to form desired images that correspond to the image data being processed, and image receiving substrates are supplied by any one of the sources 42, 44, 48 and handled by the substrate handling and treatment system 50 in timed registration with image formation on the surface 14. Finally, the image is transferred from the surface 14 onto the receiving substrate within a transfer nip 18 formed between the imaging member 12 and a transfix roller 19 that rotates in direction 17. The media bearing the transferred ink image can then be delivered to the fusing/spreading device 60 for subsequent fixing of the image to the substrate.

The printer 10 includes a drum maintenance unit (DMU) 94 to facilitate with transferring the ink images from the surface 14 to the receiving substrates. The drum maintenance unit 94 is equipped with a reservoir that contains a fixed supply of release agent, e.g., silicon oil, and an applicator for delivering the release agent from the reservoir to the surface of the rotating member. One or more elastomeric metering blades are also used to meter the release agent on the transfer surface at a desired thickness and to divert excess release agent and un-transferred ink pixels to a reclaim area of the drum maintenance unit. The collected release agent is filtered and returned to the reservoir for reuse.

The above principles of ink image formation and transfer can be applied to a novel arrangement of color separation formation stations to form a printer 100, a portion of which is shown in FIG. 1. The modified printer 100 includes a plurality of color separation modules $\mathbf{102}_x$ mounted in a tandem configuration within the frame of the printer 10. Each color separation module $\mathbf{102}_x$ includes an image receiving member $\mathbf{104}_x$ and a printhead module $\mathbf{106}_x$, which is configured to eject ink drops onto the image receiving member $\mathbf{104}_x$ to form an ink image on the surface of the image receiving member $\mathbf{104}_x$. Because the ink images formed by each color separation module are made with ink of only one color, these ink images are also known as color separations. The plurality of color separation modules $\mathbf{102}_x$ includes a cyan separation module $\mathbf{102}_1$, a magenta separation module $\mathbf{102}_2$, a yellow separation module $\mathbf{102}_3$, and a black separation module $\mathbf{102}_4$ with each color separation module $\mathbf{102}_x$ being configured to eject cyan ink, magenta ink, yellow ink, and black ink, respectively. In at least one embodiment, the plurality of color separation modules $\mathbf{102}_x$ includes at least one other color separation module $\mathbf{102}_5$ configured to eject ink drops having a color different than the cyan, magenta, yellow, and black colors ejected by the plurality of color separation modules $\mathbf{102}_1$, $\mathbf{102}_2$, $\mathbf{102}_3$, $\mathbf{102}_4$.

In different embodiments of the printer 100, each printhead module in the color separation modules can include full width printheads ejecting the same color of ink or each one can include staggered arrays of printheads ejecting the same color of ink. These printheads or staggered arrays within a printhead module can be offset from one another as described above to enable each module to print a color separation at a second resolution that is higher than the resolution of a single printhead or a staggered array of printheads in the module. The color separations printed by the color separation modules are aligned with one another to enable drop-on-drop printing of different primary colors to produce secondary colors and to enable side-by-side ink drops of different colors to extend the color gamut and hues available from the printer.

The substrate handling and transport system 50 of the printer 100 is configured to move a print medium 110 past each of the plurality of color separation modules $\mathbf{102}_x$. In the embodiment shown, the substrate handling and treatment system 50 comprises a non-continuous series of belts 114 that pass the print medium 110 from one color separation module $\mathbf{102}_x$ to the next. The series of belts are adapted to frictionally move the sheet between the color separation modules $\mathbf{102}_x$ and can include suction devices or utilize electrostatic attraction to facilitate retention of the print medium 110 on the belts. In an alternative embodiment, the substrate handling and treatment system 50 comprises a continuous escort belt (not shown) that is configured to move the print medium 110 through each of the imaging modules $\mathbf{102}_x$. The escort belt can be used to advantageously retain the print medium 110 as the medium passes through each of the color separation modules $\mathbf{102}_x$. The escort belt can similarly include suction devices or utilize electrostatic attraction to facilitate retention of the print medium 110 on the belt.

A fixing member $\mathbf{118}_x$ is positioned adjacent to each image receiving member $\mathbf{104}_x$ of the color separation modules $\mathbf{102}_x$. Each fixing member $\mathbf{118}_x$ forms a nip with the image receiving members $\mathbf{104}_x$ adjacent to the fixing member. As the print medium 110 passes through each nip, the color separation on the image receiving members $\mathbf{104}_x$ are transferred to the print medium.

Figure 2:
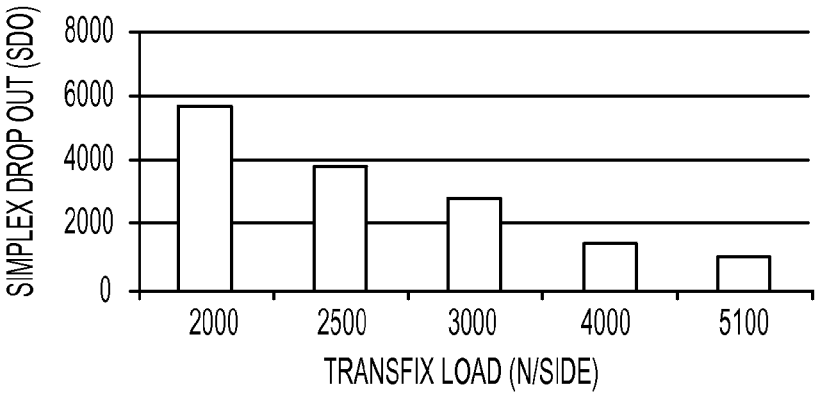
FIGS. 2-4 are graphs of simplex dropout, pixel picking, and average positive line width, respectively, versus nip load in a printer representative of the printer of FIG. 1.
Figure 3:
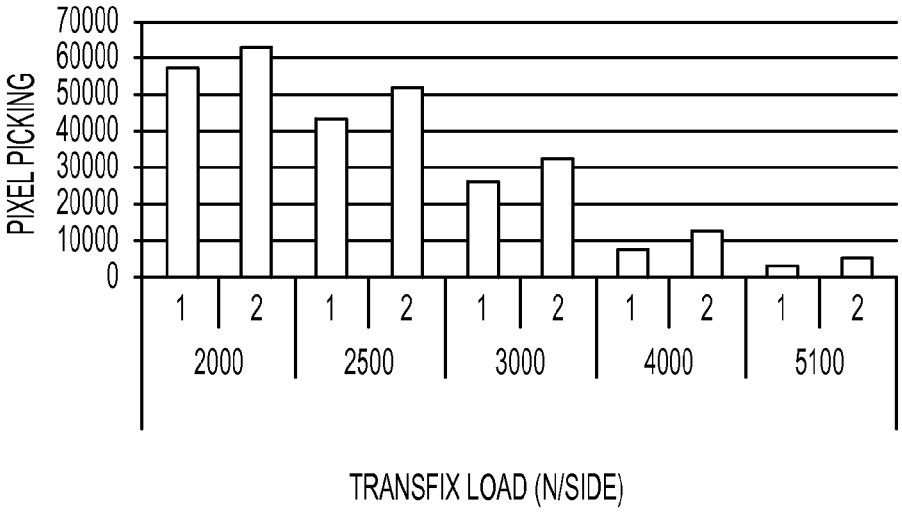
Figure 4:
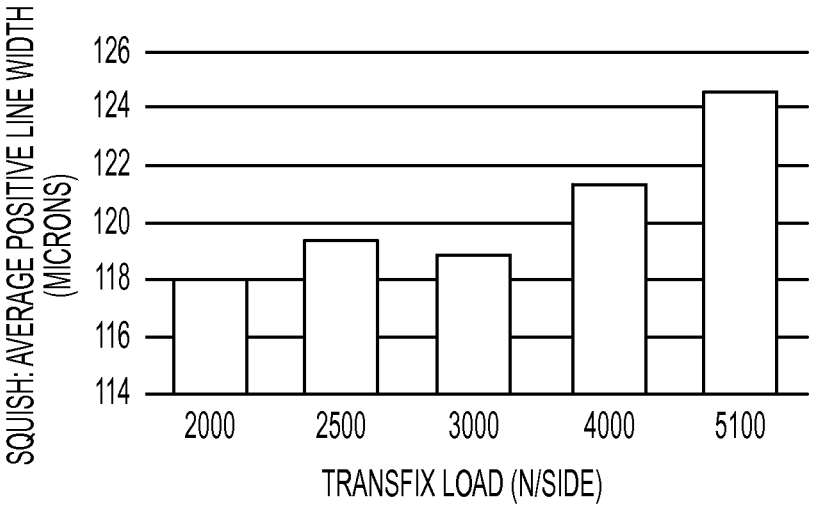

FIGS. 2-4 show data of selected print quality attributes as a function of load within the nip of a representative printer. FIG. 2 shows simplex drop out as a function of the load within the nip. Simplex drop out measures how many ink drops of a known quantity of ink drops jetted onto the image receiving member fail to transfer to the print medium during a transfer process. FIG. 3 shows pixel picking as a function of load within the nip. Pixel picking measures how many single layer ink drops of a known quantity of ink drops ejected onto the image receiving member between lines of multiple layers or stacking heights of ink drops fail to transfer to the print medium during a transfer process. In the graph shown in FIG. 3, the x-axis labels 1 and 2 refer to the first and second pitches, respectively, on the image receiving member. FIG. 4 shows the average positive line width, or "squish" as used in the industry, on the image receiving member as a function of load within the nip. Squish measures the average width of a line of ink drops on the print medium after compression of the line of ink drops between the fixing member $\mathbf{118}_x$ and the respective image receiving member $\mathbf{104}_x$. The representative printer from which the print quality attribute data was acquired utilized a 6.75 mm thick rotating image receiving member and a single layer fixing member or transfix roll.

Referring again to FIG. 1, each nip in the plurality of nips $\mathbf{120}_x$ is configured to transfix the color separation from the respective image receiving member $\mathbf{104}_x$ to the print medium 110. As used herein, "transfix" refers to a process in which a combination of heat and pressure is applied to the print medium 110 at each nip $\mathbf{120}_x$ to concurrently transfer and fix the ink image to the print medium 110 as the print medium 110 passes through the nip $\mathbf{120}_x$. To transfix the color separation from the image receiving member to the print medium, each nip $\mathbf{120}_x$ provides an effective load on both sides of the print medium 110 that is sufficient to generate a minimum peak pressure within the nip to transfer and fix the ink image to the print medium. The peak pressure within the nip is the highest pressure at a particular location along the length of the fixing member $\mathbf{118}_x$. The minimum peak nip pressure generally occurs at the middle of a length of the fixing member $\mathbf{118}_x$ due to bending of the fixing member $\mathbf{118}_x$ and the image receiving member $\mathbf{104}_x$. However, with a sufficiently large crown on the fixing member $\mathbf{118}_x$, the minimum peak nip pressure can be moved near the ends of the fixing member $\mathbf{118}_x$. The minimum peak nip pressure required to transfer and fix the ink image to the print medium is a function of the rheological properties of the ink at the temperature within the nip and the mechanical properties of the fixing member $\mathbf{118}_x$ and image receiving member $\mathbf{104}_x$ surfaces. In at least one embodiment, the effective load is approximately 5,100 N per side to generate a minimum peak nip pressure of about 6.5 MPa. A spreader, such as the fuser or spreader 60 depicted in FIG. 1, is not needed when the image is transfixed to the print medium 110 at each imaging module $\mathbf{102}_x$.

In an alternative embodiment, each nip $\mathbf{120}_x$ is configured to transfer the ink image from the respective image receiving member $\mathbf{104}_x$ to the print medium 110. In this embodiment, each nip $\mathbf{120}_x$ provides an effective load on the print medium 110 that is as low as 3,000 N per side. While the load in this embodiment is sufficient to transfer the image to the print medium 110 with acceptable simplex drop out (SDO) (as illustrated in FIG. 2), achieving acceptable pixel picking with this load is more difficult (as illustrated in FIG. 3). For example, the pixel picking measurement at 3,000 N per side is approximately 25,000 to 32,500, which is above a threshold typically considered acceptable to those skilled in the art. However, a printer using a nominal 9 mm thick rotating image receiving member and a standard two layer transfix roll with a soft outer layer can achieve improved pixel picking. In the embodiment with nips $\mathbf{120}_x$ configured to provide 3,000 N per side, a spreader 60, such as the fuser or spreader 60 depicted in FIG. 1, is needed to produce the high pressures that spread the ink adequately on the surface of the print medium 110. In such an embodiment, the effective load in the nips $\mathbf{120}_x$ except the final nip $\mathbf{120}_x$ in the process direction are approximately 3,000 N per side to generate a minimum peak nip pressure of about 3.8 MPa for the initial transfixing of the ink to the image receiving member and the final nip $\mathbf{120}_x$ has a minimum peak pressure of 6.5 MPa to spread and further fix the ink to the image receiving member.

Figure 5:
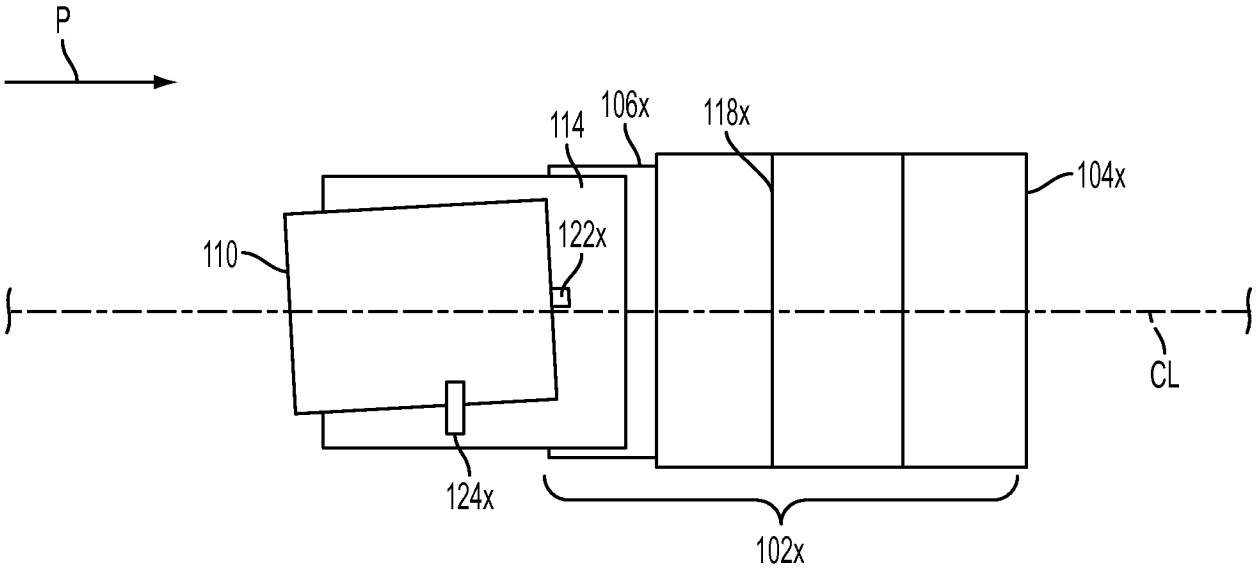
FIG. 5 is a partial view of the modified marking station of FIG. 1 as viewed in the direction indicated by arrow 5.

Referring now to FIGS. 1 and 5, the printer 100 includes a plurality of first sensors $\mathbf{122}_x$, each of which is positioned upstream of one of the nips in the plurality of nips $\mathbf{120}_x$. The first sensor $\mathbf{122}_x$ is configured to generate a signal indicative of a position of the print medium 110 prior to the print medium entering each of the nips in the plurality of nips $\mathbf{120}_x$ by detecting a leading edge of the print medium 110 as the print medium moves past the sensor $\mathbf{122}_x$. As used herein, the "leading edge" of the print medium 110 refers to an edge of the medium that is furthest downstream in the process direction (P). Although the printer 100 of FIG. 1 is shown with five first sensors $\mathbf{122}_x$ (one first sensor $\mathbf{122}_x$ preceding each color separation module $\mathbf{102}_x$), fewer or greater numbers of first sensors $\mathbf{122}_x$ can be used to signal the leading edge of the print medium 110 as the medium is moved through the plurality of color separation modules $\mathbf{102}_x$.

The printer 100 can also include a plurality of second sensors $\mathbf{124}_x$, each one of which is similarly positioned upstream of one of the nips in the plurality of nips $\mathbf{120}_x$. The second sensor $\mathbf{124}_x$ is configured to generate a signal indicative of an orientation of the print medium 110 prior to the print medium entering a nip in the plurality of nips $\mathbf{120}_x$ by detecting a lateral edge of the print medium 110 as the print medium moves past the sensor $\mathbf{124}_x$. A centerline ℄ is provided in FIG. 5 to illustrate the skewed orientation of the print medium 110 depicted in that figure. The centerline ℄ is provided only as a visual reference to highlight the skewed orientation of the print medium 110 and should not be read to identify a preferred path of the print medium through the color separation modules $\mathbf{102}_x$.

While only one second sensor $\mathbf{124}_x$ is shown in FIG. 5, greater numbers of sensors could be used to detect the lateral edge of the print medium, depending on the type of sensor, the desired accuracy of measurement, and the redundancy needed or preferred. For example, a pressure or optical sensor could be used to detect when the lateral edge of the print medium passes over each individual sensor. Moreover, although the printer 100 of FIG. 1 is shown with five second sensors $\mathbf{124}_x$ (one second sensor $\mathbf{124}_x$ preceding each imaging module $\mathbf{102}_x$), fewer or greater numbers of second sensors $\mathbf{124}_x$ can be used to signal the orientation of the print medium 110 as the medium is moved through the plurality of color separation modules $\mathbf{102}_x$.

Referring again to FIG. 1, the controller 80 is operatively connected to the substrate handling and transport system 50, each of the color separation modules $\mathbf{102}_x$, the first sensors $\mathbf{122}_x$, and the second sensors $\mathbf{124}_x$ if the printer 100 is equipped with at least one second sensor $\mathbf{124}_x$. The controller 80 is configured to detect the position of the print medium 110 with reference to the signal generated by the first sensor $\mathbf{122}_x$ as the print medium is moved toward the plurality of nips $\mathbf{120}_x$. The controller is further configured to detect the skew of the print medium 110 with reference to the signal generated by the second sensor. With the position of the print medium 110 detected, the controller 80 is configured to operate the plurality of color separation modules $\mathbf{102}_x$ to synchronize entry of the color separation on each image receiving member $\mathbf{104}_x$ with entry of the print medium 110 into each nip $\mathbf{120}_x$ to generate a full-color composite ink image on the print medium. With the skew of the print medium 110 detected, the controller is configured to rotate the ink image formed on each of the image receiving members $\mathbf{102}_x$ so that the image transferred matches the orientation of the print medium as the medium passes through each nip $\mathbf{120}_x$.

Figure 6:
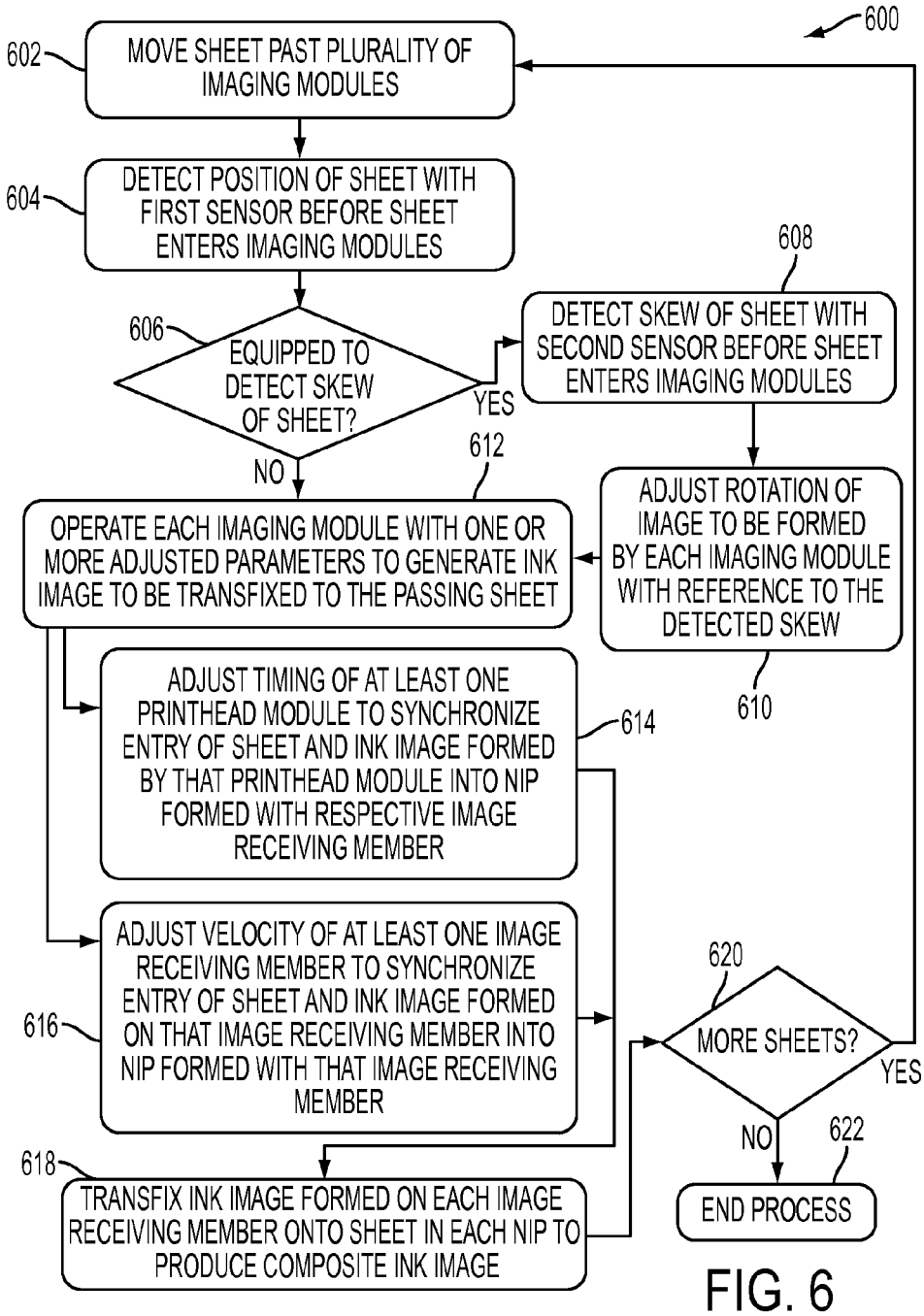
FIG. 6 is a flow diagram of the process for printing full-color composite images in the printer of FIG. 1.

A flow diagram of a process 600 for printing color composite images in a printer using a plurality of color separation modules arranged in tandem is shown in FIG. 6. The controller is configured to execute programmed instructions stored in a memory operatively connected to the controller to implement the process 600. In the discussion below, a reference to the process performing a function or action refers to a controller executing programmed instructions stored in a memory to operate one or more components to perform the function or action. The process 600 is described with reference to the printer 100 shown in FIG. 1. Process 600 begins by moving a sheet past the plurality of color separation modules (block 602). The position of the media sheet is detected with reference to a signal generated by a first sensor (block 604). If the printer is equipped to detect a skew of the sheet (block 606), the process 600 also detects the skew of the sheet with reference to a signal generated by a second sensor (block 608). Detecting the skew of the sheet before the sheet enters the color separation modules enables the controller to adjust a rotation of the ink image formed on each image receiving member to match with the detected skew of the sheet (block 610). In an alternative embodiment, the controller can operate mechanical devices, such as a pair of spaced apart nip rollers, to adjust the orientation of the sheet before the sheet enters imaging modules.

After the position of the sheet is detected (block 604) and optionally after the skew of the sheet is detected (block 608) and synchronization adjusted (block 610), process 600 operates each color separation module with one or more adjusted parameters to generate a color separation to be transferred to the passing sheet (block 612). In one embodiment, the adjusted parameter is timing for operation of a printhead module to form a color separation on the rotating image receiving member of a color separation module. In this embodiment, process 600 adjusts the timing for at least one printhead module to synchronize entry of the sheet and the ink image formed on a respective image receiving member into the nip formed with the respective image receiving member (block 614).

For example, the controller can be programmed with an expected time duration for the sheet to leave a supply source and arrive at the first color separation module in the plurality of color separation modules. The expected time duration can be a time duration derived from a known media path distance from the supply source to the first color separation module and a known sheet transport velocity. This expected time duration can then be adjusted once the leading edge of the sheet passes the first sensor. If the sheet arrives at the first sensor earlier or later than expected, the timing for the printhead module to form the ink image on the image receiving member can be delayed or accelerated, respectively, to synchronize arrival of the ink image and the sheet at the nip. The timing for the other printhead modules to form ink images on the respective image receiving members can be similarly adjusted by using a first sensor before each imaging module to detect the sheet position.

In another example, the printer can include only one first sensor positioned upstream from all of the imaging modules. In this embodiment, the timing for the first printhead module of the first imaging module to form an ink image on the respective image receiving member is adjusted by using the first sensor to detect the sheet position before the sheet enters the nip formed at the first color separation module. The timing for the other printhead modules to form ink images on the respective image receiving members is then adjusted to match known sheet behavior after the sheet passes through the first color separation module. In this example, known sheet behavior is an expected behavior of a sheet that is not based on actively sensed or real-time attributes of the moving sheet.

In an alternative embodiment, the adjusted parameter is a velocity of an image receiving member to move the ink image formed on the image receiving member to the transfer nip. In this embodiment, process 600 adjusts the velocity of at least one image receiving member to synchronize entry of the sheet and the ink image formed on the at least one image receiving member into the nip formed with the at least one image receiving member (block 616). For example, the controller can adjust the velocity of the image receiving member after the respective printhead module forms the ink image on the image receiving member to synchronize arrival of the ink image and the sheet at the nip. Similar to the timing adjustment for the printhead modules (block 614), the velocity adjustment for the color separation modules can be based on using multiple first sensors positioned upstream of each color separation module or can be based on a single first sensor positioned upstream from all of the color separation modules.

As each color separation to be transfixed is generated (block 612), process 600 transfixes the color separation from each image receiving member onto the sheet in each nip to produce a composite ink image on the sheet after the print medium has passed by all of the color separation modules (block 618). In at least one embodiment, the ink image generated by each color separation module (block 612) is formed on the respective image receiving member in a single pass. In this embodiment, a single-pass image for each color separation is formed using one or more printheads positioned around the image receiving surface, each printhead ejecting the same color ink. In this embodiment, the sheet identified to receive the generated ink image is moved toward the transfix nip of each color separation module near in time with the formation of the ink image on the image receiving member.

In an alternative embodiment, the color separation generated by each color separation module is formed on the respective image receiving member in multiple passes. This multipass image for each color separation is similarly formed using one or more printheads positioned around the image receiving surface and configured to jet the same color ink. However, the one or more printheads of this embodiment can include printheads that are movable in the cross-process direction over multiple rotations to cover the full width of the image receiving surface. In this embodiment, the sheet identified to receive the generated ink image is moved toward the transfix nip of each color separation module in synchronization with formation of the completed color separation on the image receiving member and its presentation at the nip. If no more sheets are to be printed (block 620), process 600 ends (block 622). If more sheets are to be printed (block 620), the process 600 is repeated for each additional sheet to be printed according to the process disclosed herein.

It will be appreciated that variants of the above-disclosed and other features and functions, or alternatives thereof, can be desirably combined into many other different systems, applications or methods. Various presently unforeseen or unanticipated alternatives, modifications, variations or improvements can be subsequently made by those skilled in the art that are also intended to be encompassed by the following claims.

What is claimed:

1. An inkjet printer comprising:

a frame;

a plurality of color separation modules mounted within the frame, each color separation module of the plurality of color separation modules including an image receiving member and a printhead module configured to eject ink drops onto the image receiving member to form an ink image on the image receiving member;

a media transport system configured to move a print medium past the plurality of color separation modules;

a plurality of fixing members, each fixing member being positioned adjacent to one of the image receiving members to form a plurality of nips into which the media transport system delivers the print medium, the nips being configured to transfix the ink image from each of the image receiving members onto the print medium;

a first sensor configured to generate a signal indicative of a position of the print medium prior to the print medium entering the plurality of nips, and a controller operatively connected to each of the color separation modules, the media transport system, and the first sensor, the controller being configured to:

detect the position of the print medium with reference to the signal generated by the first sensor; and operate the plurality of color separation modules to synchronize entry of the ink image on each image receiving member with entry of the print medium into each nip with reference to the detected position of the print medium to generate a full-color ink image on the print medium.

2. The inkjet printer of claim 1 wherein the plurality of color separation modules includes a cyan color separation module, a magenta color separation module, a yellow color separation module, and a black color separation module.

3. The inkjet printer of claim 2 further comprising:

at least one other color separation module configured to eject ink drops having a color different than the cyan, magenta, yellow, and black colors ejected by the plurality of color separation modules.

4. The inkjet printer of claim 1, the controller being further configured to:

adjust a speed of the image receiving member in each imaging module to synchronize entry of the ink image on the image receiving member into the nip formed with the image receiving member with entry of the print medium into the nip formed with the image receiving member.

5. The inkjet printer of claim 1, the controller being further configured to:

adjust a timing of the printhead module of each color separation module to synchronize entry of the print medium and the ink image formed on the image receiving member into the nip formed with the image receiving member.

6. The inkjet printer of claim 1 further comprising:

a second sensor configured to generate a signal indicative of a skew of the print medium prior to the print medium entering the plurality of nips.

7. The inkjet printer of claim 6, the controller being further configured to:

detect the skew of the print medium with reference to the signal generated by the second sensor; and rotate the ink image formed on each of the image receiving members with reference to the detected skew of the print medium.

8. The inkjet printer of claim 1 wherein each nip of the plurality of nips provides a minimum peak pressure between the image receiving member and the fixing member to transfix the ink drops from the image receiving member to the print medium with acceptable simplex dropout and pixel picking.

9. The inkjet printer of claim 8 wherein the minimum peak pressure within each nip is approximately 6.5 MPa.

10. The inkjet printer of claim 8 wherein the minimum peak pressure within each nip in the plurality of nips except a final nip is approximately 3.8 MPa, and the minimum peak pressure within the final nip is approximately 6.5 MPa.

11. The inkjet printer of claim 1 wherein each printhead module includes a first printhead and a second printhead, the first and second printheads being configured to eject ink drops having a same color to build a single separation image in a single pass.

12. The inkjet printer of claim 1 wherein each printhead module includes at least one printhead that is configured to eject ink drops having a same color and is movable in the cross-process direction to build a single separation image in multiple passes.

13. The inkjet printer of claim 1 wherein the media transport system includes an escort belt configured to move the print medium through the plurality of nips.

* * * * *